US010636364B2

(12) United States Patent
Yang et al.

(10) Patent No.: US 10,636,364 B2
(45) Date of Patent: Apr. 28, 2020

(54) GAMMA VOLTAGE CORRECTION METHOD AND SYSTEM FOR DISPLAY MODULE

(71) Applicants: BOE TECHNOLOGY GROUP CO., LTD., Beijing (CN); ORDOS YUANSHENG OPTOELECTRONICS CO., LTD., Ordos, Inner Mongolia (CN)

(72) Inventors: Hualing Yang, Beijing (CN); Lina Liu, Beijing (CN)

(73) Assignees: BOE TECHNOLOGY GROUP CO. LTD., Beijing (CN); ORDOS YUANSHENG OPTOELECTRONICS CO., LTD., Ordos, Inner Mongolia (CN)

( * ) Notice: Subject to any disclaimer, the term of this patent is extended or adjusted under 35 U.S.C. 154(b) by 49 days.

(21) Appl. No.: 16/145,881

(22) Filed: Sep. 28, 2018

(65) Prior Publication Data

US 2019/0130844 A1 May 2, 2019

(30) Foreign Application Priority Data

Oct. 31, 2017 (CN) ..... 2017 1 1044308

(51) Int. Cl.

*G09G 3/3275* (2016.01)
*G09G 3/20* (2006.01)
*G09G 3/3208* (2016.01)

(52) U.S. Cl.

CPC ..... *G09G 3/3275* (2013.01); *G09G 3/2007* (2013.01); *G09G 3/3208* (2013.01); *G09G 2310/027* (2013.01); *G09G 2310/0221* (2013.01); *G09G 2320/0233* (2013.01); *G09G 2320/0673* (2013.01); *G09G 2360/145* (2013.01)

(58) Field of Classification Search

CPC combination set(s) only.
See application file for complete search history.

(56) References Cited

U.S. PATENT DOCUMENTS

2016/0196793 A1* 7/2016 Xu ..... G09G 3/3611 345/694
2017/0140692 A1* 5/2017 Xiong ..... G09G 3/2074

* cited by examiner

*Primary Examiner* — Robin J Mishler
(74) *Attorney, Agent, or Firm* — Myers Bigel, P.A.

(57) ABSTRACT

Embodiments of the disclosure provide a gamma voltage correction method and system for a display module. A display area of the display module includes adjacent first sub-display area and second-sub-display area, which are independently driven by different source drivers respectively. The method comprises performing gamma curve adjustment to the first sub-display area according to a target gamma curve to obtain a first data voltage corresponding to a first grayscale; driving the second sub-display area with the first data voltage so that the second sub-display area emits light; and regulating the first data voltage based on a difference in brightness between the first-sub-display area and the second-sub-display area when driven by the first data voltage respectively to obtain a second data voltage for driving the second sub-display area so as to reduce a brightness difference between the first sub-display area and the second sub-display area.

20 Claims, 4 Drawing Sheets

GAMMA VOLTAGE CORRECTION METHOD AND SYSTEM FOR DISPLAY MODULE

CROSS REFERENCE RELATED APPLICATION

The present application claims the benefit of Chinese Patent Application No. 201711044308.6, filed on Oct. 31, 2017, the entire disclosure of which is incorporated herein by reference.

TECHNICAL FIELD

The present disclosure generally relates to the field of display technologies, and particularly to a gamma voltage correction method and system for a display module.

BACKGROUND

Currently, organic light-emitting diode (OLED) display modules have been widely used due to their advantages such as self-illumination, high contrast, thinness, fast response, flexible display, and the like. Generally, after an OLED display module is fabricated, it is required to modulate its brightness under different grayscales according to a target gamma curve to make the brightness under respective grayscales of the OLED display module conform to the target gamma curve, so that an OLED display device can accurately display details of different brightness in an image when displaying the image. Gamma voltage is a data voltage that is set for grayscale display of the OLED display module according to the target gamma curve. The gamma voltage is converted into an analog voltage by a digital-to-analog converter in a data driving chip (source driver), and finally provided to a data signal line in the OLED display device, thereby realizing image display.

At present, as large-sized display screens have been applied more and more widely, the data driving chip of the display module is required to have more output signal channels to meet the requirements on resolution. However, limited by the current manufacturing process for the data driving chip, it may be difficult for a single data driving chip to satisfy large-sized display devices that require a higher resolution. Therefore, in some display devices, two or even more data driving chips are used to drive the display module.

SUMMARY

An embodiment of the present disclosure provides a gamma voltage correction method for a display module that is different from the prior art. A display area of the display module includes adjacent first sub-display area and second-sub-display area, the first sub-display area and the second-sub-display area being independently driven by different source drivers respectively. The gamma voltage correction method provided by this embodiment comprises the steps of: performing gamma curve adjustment to the first sub-display area according to a target gamma curve to obtain a first data voltage corresponding to a first grayscale; driving the second sub-display area with the first data voltage so that the second sub-display area emits light; regulating the first data voltage based on a difference in brightness between the first-sub-display area and the second-sub-display area when driven by the first data voltage respectively to obtain a second data voltage for driving the second sub-display area so as to reduce a brightness difference between the first sub-display area and the second sub-display area.

In some embodiments of the present disclosure, the method further comprises: driving the first sub-display area with the first data voltage so that the first sub-display area emits light, while acquiring a first brightness parameter at a first position in the first sub-display area close to a boundary between the first sub-display area and the second sub-display area, the first brightness parameter including a first brightness value and a first chromaticity coordinate corresponding to the first brightness value.

Further, in some embodiments, the method further comprises: at the time of driving the second sub-display area with the first data voltage so that the second sub-display area emits light, acquiring a second brightness parameter at a second position in the second sub-display area close to the boundary, the second brightness parameter including a second brightness value and a second chromaticity coordinate corresponding to the second brightness value.

In some embodiments, pixels at the first position and the second position are connected to a same gate line.

In some embodiments of the present disclosure, the first grayscale may include any grayscale of an image displayed by the display module, which is e.g., a maximum grayscale.

In some embodiments, the method further comprises: comparing the second brightness parameter with a target brightness parameter that includes a target brightness value and a third chromaticity coordinate corresponding to the target brightness value, so as to obtain a first brightness variance between the second brightness value and the target brightness value and a first chromaticity coordinate variance between the second chromaticity coordinate and the third chromaticity coordinate.

In some embodiments, the method further comprises: if the first brightness variance exceeds a first brightness threshold, or the first chromaticity coordinate variance exceeds a first chromaticity coordinate threshold, increasing or decreasing a value of the first data voltage applied to the second sub-display area until the first brightness variance is less than the first brightness threshold, and the first chromaticity coordinate variance is less than the first chromaticity coordinate threshold.

In some embodiments, the method further comprises: if the first brightness variance is less than the first brightness threshold, and the first chromaticity coordinate variance is less than the first chromaticity coordinate threshold, comparing the first brightness parameter with the second brightness parameter to obtain a second brightness variance between the first brightness value and the second brightness value, and a second chromaticity coordinate variance between the first chromaticity coordinate and the second chromaticity coordinate.

In some embodiments, the method further comprises: if the second brightness variance exceeds a second brightness threshold, or the second chromaticity coordinate variance exceeds a second chromaticity coordinate threshold, increasing or decreasing the value of the first data voltage applied to the second sub-display area until the second brightness variance is less than the second brightness threshold, and the second chromaticity coordinate variance is less than the second chromaticity coordinate threshold.

In some embodiments, the method comprises: if the second brightness variance is less than the second brightness threshold, and the second chromaticity coordinate variance is less than the second chromaticity coordinate threshold, storing a corresponding regulated first data voltage as the second data voltage.

In some embodiments, at the time of acquiring the first brightness parameter and the second brightness parameter, the first sub-display area and the second sub-display area emit white light.

Another embodiment of the present disclosure provides a gamma voltage correction system for a display module, a display area of the display module including adjacent first-sub-display area and second sub-display area, the first sub-display area and the second sub-display being independently driven by different source drivers respectively, the gamma voltage correction system at least comprising an optical sensor and a controller. The optical sensor is configured to acquire brightness of the first sub-display area and the second sub-display area when driven by a first data voltage respectively, where the first data voltage is a data voltage obtained by performing gamma curve adjustment to the first sub-display area according to a target gamma curve and corresponding to a first grayscale. The controller is configured to regulate the first data voltage based on a difference in brightness between the first sub-display area and the second sub-display area when driven by the first data voltage respectively to obtain a second data voltage for driving the second sub-display area so as to reduce a brightness difference between the first sub-display area and the second sub-display area.

In some embodiments, the optical sensor is configured to acquire a first brightness parameter at a first position in the first sub-display area close to a boundary between the first sub-display area and the second sub-display area, and a second brightness parameter at a second position in the second sub-display area close to the boundary, the first brightness parameter including a first brightness value and a first chromaticity coordinate corresponding to the first brightness value, the second brightness parameter including a second brightness value and a second chromaticity coordinate corresponding to the second brightness value.

Further, in some embodiments, pixels at the first position and the second position are connected to a same gate line.

In some embodiments, the controller comprises a first comparator for comparing the second brightness parameter with a target brightness parameter that includes a target brightness value and a third chromaticity coordinate corresponding to the target brightness value, so as to obtain a first brightness variance between the second brightness value and the target brightness value, and a first chromaticity coordinate variance between the second chromaticity coordinate and the third chromaticity coordinate.

In some embodiments, the controller comprises an operator configured to, in response to the first brightness variance exceeding a first brightness threshold, or the first chromaticity coordinate variance exceeding a first chromaticity coordinate threshold, increase or decrease a value of the first data voltage applied to the second sub-display area until the first brightness variance is less than the first brightness threshold, and the first chromaticity coordinate variance is less than the first chromaticity coordinate threshold.

In some embodiments, the controller comprises a second comparator configured to, in response to the first brightness variance being less than the first brightness threshold and the first chromaticity coordinate variance being less than the first chromaticity coordinate threshold, compare the first brightness parameter with the second brightness parameter to obtain a second brightness variance between the first brightness value and the second brightness value, and a second chromaticity coordinate variance between the first chromaticity coordinate and the second chromaticity coordinate.

In some embodiments, the operator is configured to, in response to the second brightness variance exceeding a second brightness threshold, or the second chromaticity coordinate variance exceeding a second chromaticity coordinate threshold, increase or decrease the value of the first data voltage applied to the second sub-display area until the second brightness variance is less than the second brightness threshold, and the second chromaticity coordinate variance is less than the second chromaticity coordinate threshold.

In some embodiments, the gamma voltage correction system for a display module further comprises a memory, the memory being used for storing the first data voltage and storing a corresponding regulated first data voltage as the second data voltage.

Some embodiments of the present disclosure have been briefly summarized above, and it will be appreciated by those skilled in the art that the features of the embodiments described above can be combined in various ways to form a number of other different embodiments.

BRIEF DESCRIPTION OF DRAWINGS

Embodiments of the present disclosure will be described below in more detail with reference to the accompanying drawings by way of non-limiting examples to provide a thorough understanding of the principle and spirit of the disclosure, in which FIG. 1 schematically shows partial components of a display module according to an embodiment of the present disclosure.

DETAILED DESCRIPTION

Figure 1:
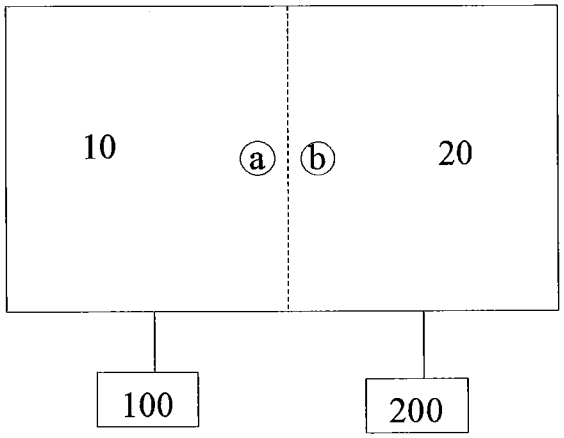

Some embodiments of the present disclosure will now be described in detail by way of examples, examples of which are illustrated in the drawings. Those skilled in the art will appreciate that the embodiments described below are only a part of possible embodiments of the disclosure, rather than all of them. Other embodiments obtained by making obvious modifications or variations to the embodiments provided herein under the guidance of the technical idea revealed herein also fall within the scope of the disclosure.

Inventors of the disclosure has found that gamma voltage correction performed for the display module using conventional methods results in an unsatisfactory display effect of the display device. For example, a significant difference in brightness often occurs at the interface between different sub-display areas driven by different data driving chips, degrading the quality of the displayed image. Moreover, it is relatively time-consuming to perform gamma voltage correction for the display module using the conventional methods, because with the conventional methods, gamma voltage adjustment needs to be performed independently to a plurality of sub-display areas of the display module to which a plurality of data driving chips correspond, resulting in low production efficiency of the display device.

FIG. 1 illustrates a display module driven by two source drivers (data driving chips). In order to facilitate the explanation of the principle and process of the gamma voltage correction method proposed by the embodiments herein, in FIG. 1, sub-display areas of the display module driven by different source drivers are separated by a broken line. As shown in FIG. 1, the display area of the display module includes adjacent first sub-display area 10 and second sub-display area 20, and the first sub-display area 10 and the second sub-display area 20 are independently driven by two different source drivers 100 and 200 respectively. It can be understood that although FIG. 1 only shows an example of a display module including the first sub-display area 10 and the second sub-display area 20, in other embodiments, the display module may be divided into more sub-display areas. That is, the display module may be driven by more than two source drivers, and the number of sub-display areas corresponds to the number of source drivers used.

Figure 2:
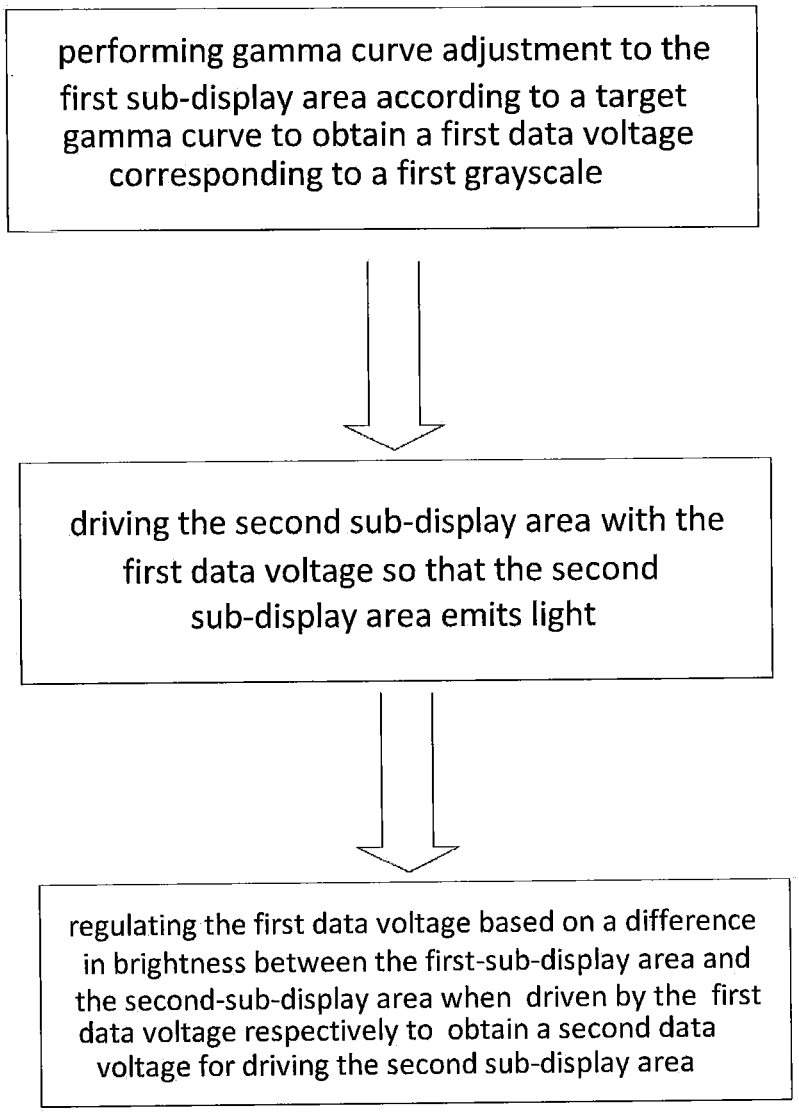
FIG. 2 schematically shows a flow chart of a gamma voltage correction method for a display module according to an embodiment of the present disclosure.

FIG. 2 schematically shows a gamma voltage correction method for the display module shown in FIG. 1. The method may comprise the following steps: S1, performing gamma curve adjustment to the first sub-display area according to a target gamma curve to obtain a first data voltage corresponding to a first grayscale; S2, driving the second sub-display area using the first data voltage so that the second sub-display area emits light; S3, regulating the first data voltage based on a difference in brightness between the first sub-display area and the second sub-display area when driven by the first data voltage to obtain a second data voltage for driving the second sub-display area, so as to reduce a brightness difference between the first sub-display area and the second sub-display area.

The above step S1 in the embodiment of the disclosure can be implemented by means of an existing method. The target gamma curve may be e.g. the "2.2 gamma curve" well known to those skilled in the art. Of course, the target gamma curve mentioned herein is not so limited, which may be any standard gamma curves required by different customers. The gamma curve adjustment performed to the first sub-display area according to the target gamma curve is actually a process of making the actual gamma curve of the first sub-display area of the current display module coincide with the target gamma curve. Any existing gamma curve adjustment method can be employed, for example, the gamma curve adjustment method disclosed in the patent publication No. CN105702215A. A variety of gamma curve adjustment methods are known to those skilled in the art, which are not described herein for brevity.

It can be understood that the first data voltage is a data voltage that conforms to the target gamma curve and corresponds to the first grayscale. The "first grayscale" mentioned herein may be any grayscale value for the display module, which, for example, may be the maximum grayscale (e.g., for an 8-bit digital/analog converter in the source driver, the maximum grayscale is 255), and may also be other grayscale values. In practice, a plurality of data voltages corresponding to different grayscale values may be stored.

It can be appreciated from the gamma voltage correction method for a display module as provided by the embodiment of the disclosure that, the first data voltage suitable for the first sub-display area is firstly provided to the second sub-display area so that the second sub-display area emits light under the driving of the first data voltage, and then the first data voltage is regulated to obtain a second data voltage suitable for the second sub-display area. Specifically, the first data voltage is regulated based on a difference in brightness between the first sub-display area and the second sub-display area when driven by the first data voltage respectively, such that the difference in brightness between the first sub-display area and the second sub-display area is reduced. That is, with embodiments of the disclosure, after obtaining the first data voltage suitable for the first sub-display area, the first data voltage is regulated dependent on the difference in brightness between the first sub-display area and the second sub-display area when driven by the first data voltage respectively, thereby obtaining the second data voltage suitable for the second sub-display area. As a result, the brightness difference between the first sub-display area and the second sub-display area driven by different source drivers respectively can be decreased. In addition, with the method proposed by the embodiment of the disclosure, for the adjacent first sub-display area and second sub-display area, only one of them is subjected to gamma curve adjustment, therefore, time required for the gamma voltage correction process of the entire display module is shortened, which in turn improves the production efficiency of the display device.

The first data voltage and the second data voltage obtained using the method proposed by the embodiment of the present disclosure can be stored in a register or a memory to be called by the display device at runtime. As previously mentioned, a plurality of data voltages corresponding to different grayscale values may be stored. That is, by means of the method proposed by embodiments herein, a plurality of first data voltages corresponding to different grayscales suitable for the first sub-display area, and a plurality of second data voltages corresponding to different grayscales suitable for the second sub-display area can be obtained. When the display device is in normal operation, the data voltages stored in the register or memory can be called according to the target grayscale values for different pixels to which the image to be displayed corresponds, thereby realizing image display.

According to some embodiments of the disclosure, the gamma voltage correction method for a display module further comprises the following steps: driving the first sub-display area with the first data voltage such that the first sub-display area emits light, while acquiring a first brightness parameter at a first position in the first sub-display area close to a boundary between the first sub-display area and the second sub-display area, where the first brightness parameter includes a first brightness value and a first chromaticity coordinate corresponding to the first brightness value. This embodiment of the present disclosure is still explained with the aid of FIG. 1. The broken line in FIG. 1 indicates the boundary between the first sub-display area and the second sub-display area, a in FIG. 1 indicates the first position in the first sub-display area 10, and b indicates a second position in the second sub-display area 20. In this embodiment, the first sub-display area 10 emits light (for example, white light) under the driving of the first data voltage. At that time, a color analyzer may be used to acquire the first brightness parameter at the first position a in the first sub-display area close to the boundary, and the first brightness value and the first chromaticity coordinate corresponding to the first brightness value can be determined by the color analyzer. In this case, the first brightness parameter can be expressed as $L_1@(x_1,y_1)$.

Further, according to an embodiment of the present disclosure, the gamma voltage correction method for a display module further comprises: acquiring a second brightness parameter at the second position in the second sub-display area close to the boundary at the time of driving the second sub-display area to emit light with the first data voltage, where the second brightness parameter includes a second brightness value and a second chromaticity coordinate corresponding to the second brightness value. The second brightness parameter can be expressed as $L_2@(x_2,y_2)$. As shown in FIG. 1, the second position in the second sub-display area 20 is denoted by b. Since the first sub-display area and the second sub-display area are driven by different source drivers respectively, that is, the pixels in the first sub-display area and the pixels in the second sub-display area receive data signals from different source drivers respectively, and the difference in visual brightness between the sub-display area and the second sub-display area is relatively significant at the boundary therebetween, the difference in brightness between the first position and the second position can be obtained by acquiring the first brightness parameter $L_1@(x_1,y_1)$ for the first position and the second brightness parameter $L_2@(x2,y_2)$ for the second position, so that the data voltage for the second sub-display area can be regulated based on the difference in brightness, so as to reduce the difference in brightness. It can be understood that the closer the first position and the second position are to the boundary, the more advantageous it is to reduce the difference in brightness at the boundary. Therefore, "close to the boundary" mentioned herein means that the horizontal distance from the first position or the second position to the boundary does not exceed a predetermined value which may be a small value predetermined according to the size of the display module.

In an embodiment of the disclosure, the first position in the first sub-display area and the second position in the second sub-display area are on the same horizontal line. As shown in FIG. 1, the first position a and the second position b are on the same horizontal line. Generally, data lines in the display module are arranged in the vertical direction in the display module, and data voltages at different positions on the data lines slightly vary because of the impedances of the data lines. Selecting the first position and the second position on the same horizontal line may help to finely improve the brightness uniformity between the first sub-display area and the second sub-display area, because the data voltages at the first position and the second position on the same horizontal line may be considered to have experienced substantially the same voltage drop caused by the impedances of the data lines.

In order to obtain the difference in brightness between the first sub-display area and the second sub-display area when driven by the first data voltage respectively, according to an embodiment of the present disclosure, after the first brightness parameter $L_1@(x_1,y_1)$ and the second brightness parameter $L_2@(x_2,y_2)$ are acquired, they may be compared to obtain a variance between the first brightness value and the second brightness value (referred to herein as "second brightness variance") and a variance between the first chromaticity coordinate and the second chromaticity coordinate (referred to herein as "second chromaticity coordinate variance"). At that time, it can be determined whether the variance between the first brightness parameter $L_1@(x_1,y_1)$ and the second brightness parameter $L_2@(x_2,y_2)$ meets the specification. If the specification is satisfied, the data voltage currently applied to the second sub-display area can be used as the second data voltage and stored in a memory or a register. Otherwise, the data voltage (i.e. first data voltage) currently applied to the second sub-display area is fine-regulated (e.g. increased or decreased) until the variance between the first brightness parameter and the second brightness parameter meets the specification. The variance between the first brightness parameter $L_1@(x_1,y_1)$ and the second brightness parameter $L_2@(x_2,y_2)$ includes the second brightness variance $\Delta L=L1-L2$, and the second chromaticity coordinate variance $(\Delta x, \Delta y)=(x_1-x_2, y_1-y_2)$. Determining whether the variance between the first brightness parameter $L_1@(x_1,y_1)$ and the second brightness parameter $L_2@(x_2,y_2)$ meets the specification may be specifically implemented as determining whether the second brightness variance exceeds a second brightness threshold and determining whether the second chromaticity coordinate variance exceeds a second chromaticity coordinate threshold. The second brightness threshold and the second chromaticity coordinate threshold may be predetermined according to different applications of the display module or different customer requirements. For example, the second brightness threshold may e.g. be ±2 nit, and the second chromaticity coordinate threshold $(\Delta x, \Delta y)$ may e.g. be ±0.002.

In a further embodiment of the disclosure, the gamma voltage correction method for a display module further comprises: after acquiring the second brightness parameter described above, comparing the second brightness parameter with a target brightness parameter that includes a target brightness value and a third chromaticity coordinate corresponding to the target brightness value, thereby obtaining a variance between the second brightness value and the target brightness value (referred to herein as "first brightness variance") and a variance between the second chromaticity coordinate and the third chromaticity coordinate (referred to herein as "first chromaticity coordinate variance"). It can be determined whether the second brightness parameter meets a predetermined specification based on the first brightness variance and the first chromaticity coordinate variance. For example, in an embodiment, if the first brightness variance exceeds a first brightness threshold, or the first chromaticity coordinate variance exceeds a first chromaticity coordinate threshold, it indicates that there is a need to adjust the data voltage currently applied to the second sub-display area, i.e. increasing or decreasing the value of the first data voltage applied to the second sub-display area, until the first brightness variance is less than the first brightness threshold and the first chromaticity coordinate variance is less than the first chromaticity coordinate threshold. The target brightness parameter, the first brightness threshold, and the first chromaticity coordinate threshold may be predetermined according to different applications of the display module or different customer requirements. For example, the target brightness value corresponding to the maximum grayscale may be 380 nit, and the chromaticity coordinate corresponding to the target brightness value is (0.30, 0.32), that is, the target brightness parameter may be expressed as 380 nit@(0.30, 0.32), the first brightness threshold is ±1%*380, and the chromaticity coordinate variance is ±0.005. In this way, the display brightness of the display module can be further brought close to the desired effect, and the quality of the displayed image can be improved.

Figure 3:
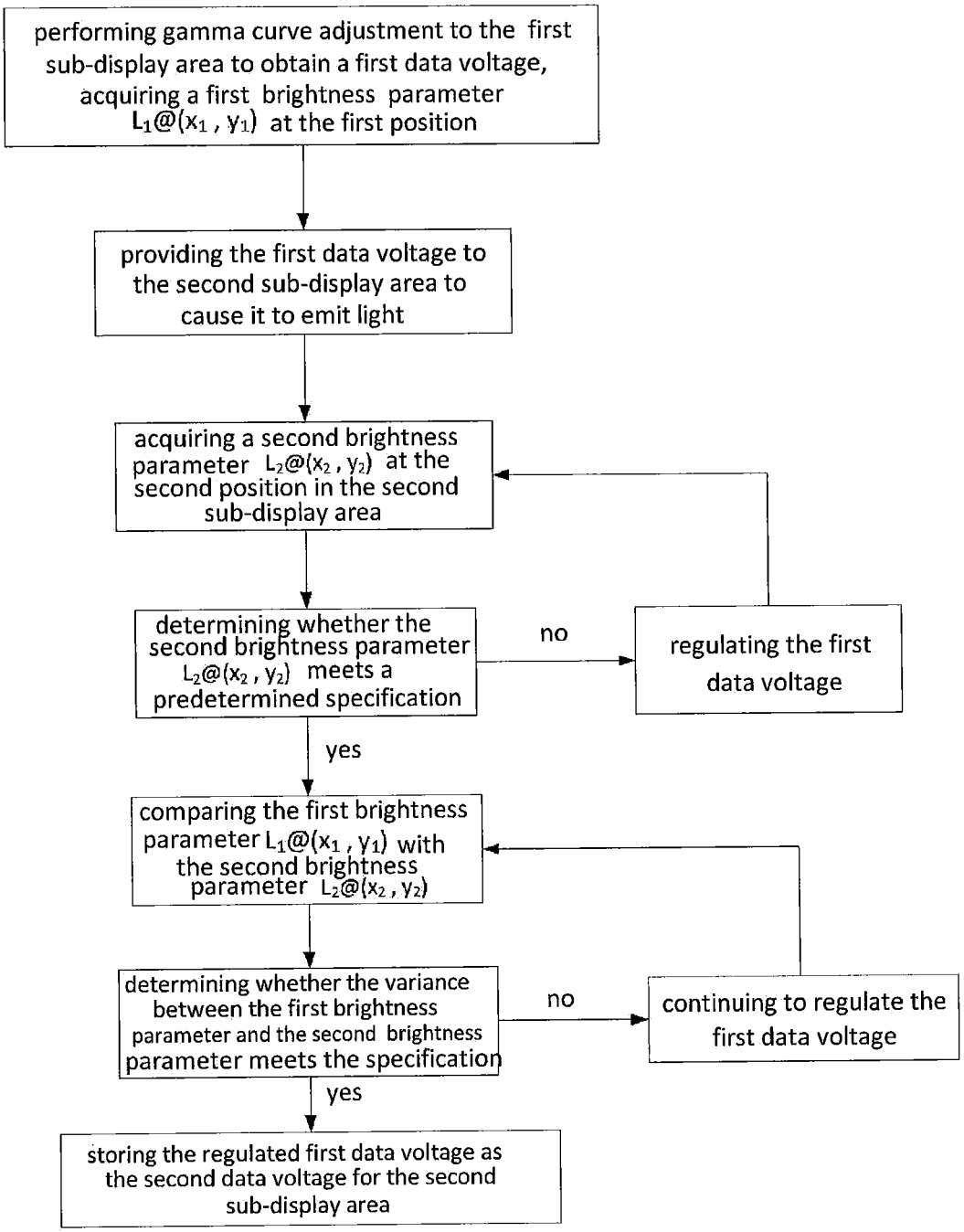
FIG. 3 schematically shows a flow chart of a gamma voltage correction method for a display module according to another embodiment of the present disclosure.

That is, in this embodiment, it is first determined that the second brightness parameter of the second sub-display area meets a certain predetermined specification, and then the data voltage for the second sub-display area continues to be regulated to reduce the difference in brightness between the first sub-display area and the second sub-display area. FIG. 3 schematically shows a flow chart of the gamma voltage correction method for a display module according to an embodiment of the disclosure. As shown in FIG. 3, and in conjunction with FIG. 1, firstly, gamma curve adjustment is performed for the first sub-display area 10 to obtain the first data voltage, and the first brightness parameter $L_1@(x_1,y_1)$ at the first position a is acquired. The first data voltage is saved and provided to the second sub-display area such that the second sub-display area emits light under the driving of the first data voltage. At that time, the second brightness parameter $L_2@(x_2,y_2)$ at the second position b of the second sub-display area is acquired, and the first position a and the second position b may be on the same horizontal line. Thereafter, it is determined whether the second brightness parameter $L_2@(x_2,y_2)$ meets the predetermined specification, and if not, the first data voltage for the second sub-display area is increased or decreased until the acquired second brightness parameter $L_2@(x_2,y_2)$ meets the predetermined specification. In case the second brightness parameter $L_2@(x_2,y_2)$ meets the predetermined specification, the second brightness parameter $L_2@(x_2,y_2)$ and the first brightness parameter $L_1@(x_1,y_1)$ are compared to determine whether the variance between them meets a certain specification. If not, the data voltage applied to the second sub-display area continues to be varied (increased or decreased) until the variance between the second brightness parameter $L_2@(x_2,y_2)$ and the first brightness parameter $L_1@(x_1,y_1)$ meets the certain specification. In case the variance between the second brightness parameter and the first brightness parameter meets the predetermined specification, the value of the regulated first data voltage is stored in a register or a memory as the second data voltage for the sub-display area 20.

The above examples illustrate the process of obtaining the first data voltage and the second data voltage corresponding to the first grayscale (which may for example be the maximum grayscale). It can be understood that a plurality of first data voltages and a plurality of second data voltages corresponding to other grayscales can be obtained based on the method. On such basis, first data voltages and second data voltages corresponding to all the grayscales can be calculated by means of an existing algorithm, which is well known to those skilled in the art and will not be described in detail herein. Therefore, when the display device is in normal operation, corresponding first data voltages or second data voltages stored in the register or the memory can be called according to the target grayscale values for different pixels to which the image to be displayed corresponds, thereby realizing image display.

Figure 4:
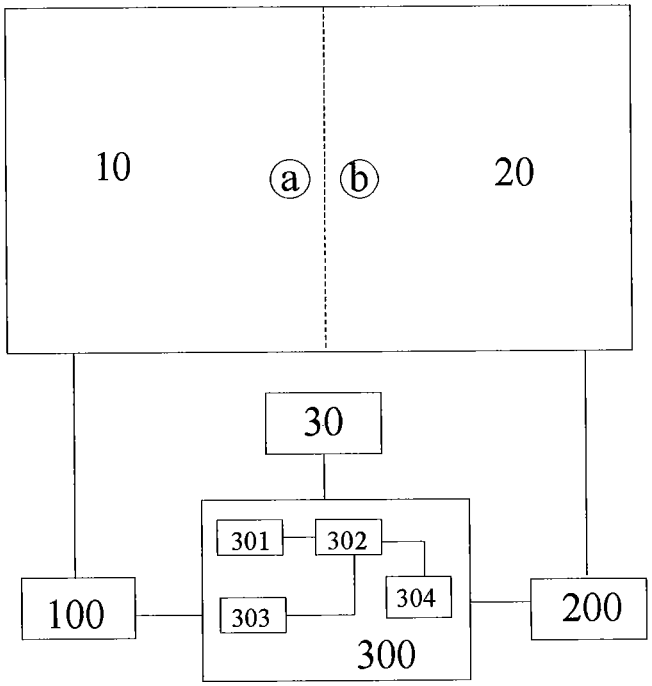
FIG. 4 schematically shows a gamma voltage correction system for a display module according to a further embodiment of the present disclosure.

Another embodiment of the disclosure provides a gamma voltage correction system for a display module. FIG. 4 schematically shows part of the components of the system. As shown in FIG. 4, the display area of the display module includes adjacent first sub-display area 10 and second sub-display area 20, and the first sub-display area 10 and the second sub-display area 20 are independently driven by a source driver 100 and a source driver 200 respectively. The system comprises an optical sensor 30 and a controller 300. The optical sensor may be a color analyzer that can acquire brightness of the first sub-display area 10 and the second sub-display area 20 when driven by the first data voltage, respectively. The first data voltage mentioned in this embodiment has the same meaning as the first data voltage mentioned in the previous embodiments. That is, the first data voltage is a data voltage obtained by performing gamma curve adjustment to the first sub-display area according to a target gamma curve and corresponding to the first grayscale. The first grayscale mentioned here includes, but is not limited to, the maximum grayscale of an image displayed by the display module. The controller 300 is connected to the source driver 100, the source driver 200, and the optical sensor 30, respectively, which is used for regulating the first data voltage based on the difference in brightness between the first sub-display area 10 and the second sub-display area 20 when driven with the first data voltage respectively, to obtain a second data voltage for driving the second sub-display area 20 so as to reduce the difference in brightness between the first sub-display area 10 and the second sub-display area 20.

In the embodiment of FIG. 4, the optical sensor 30 may be configured to acquire a first brightness parameter at a first position a in the first sub-display area 10 close to a boundary between the first sub-display area and the second sub-display area, and a second brightness parameter at a second position b in the second sub-display area 20 close to the boundary, where the first brightness parameter includes a first brightness value and a first chromaticity coordinate corresponding to the first brightness value, and the second brightness parameter includes a second brightness value and a second chromaticity coordinate corresponding to the second brightness value. In an embodiment, the optical sensor 30 may include an optical probe (not shown in FIG. 4 for clarity) that may be placed directly above the first position a and the second position b to obtain the brightness parameters at the first position a and the second position b. Further, in the embodiment shown in FIG. 4, the pixels of the first position a and the second position b are connected to the same gate line. That is, the first position a and the second position b are on the same horizontal line in FIG. 4. Generally, data lines in the display module are arranged in the vertical direction in the display module, and data voltages at different positions on the data lines vary due to the impedances of the data lines. Selecting the first position and the second position connected to the same gate line may help to finely improve the brightness uniformity between the first sub-display area and the second sub-display area, because the data voltages at the first position and the second position on the same horizontal line may be considered to have experienced substantially the same voltage drop caused by the impedances of the data lines.

FIG. 4 also illustrates a schematic diagram of the controller 300. The controller 300 includes a first comparator 301 and an operator 302. The first comparator 301 is used for comparing the second brightness parameter with a target brightness parameter that includes a target brightness value and a third chromaticity coordinate corresponding to the target brightness value, to obtain a first brightness variance between the second brightness value and the target brightness value, and a first chromaticity coordinate variance between the second chromaticity coordinate and the third chromaticity coordinate. The operator 302 is configured to, in response to the first brightness variance exceeding a first brightness threshold or the first chromaticity coordinate variance exceeding a first chromaticity coordinate threshold, increase or decrease the value of the first data voltage applied to the second sub-display area 20 until the first brightness variance is less than the first brightness threshold and the first chromaticity coordinate variance is less than the first chromaticity coordinate threshold.

In some embodiments, the controller 300 further includes a second comparator 303. The second comparator 303 is configured to, in response to the first brightness variance being less than the first brightness threshold and the first chromaticity coordinate variance being less than the first chromaticity coordinate threshold, compare the first brightness parameter with the second brightness parameter to obtain a second brightness variance between the first brightness value and the second brightness value, and a second chromaticity coordinate variance between the first chromaticity coordinate and the second chromaticity coordinate.

Further, the operator 302 may be configured to, in response to the second brightness variance exceeding a second brightness threshold, or the second chromaticity coordinate variance exceeding a second chromaticity coordinate threshold, increase or decrease the value of the first data voltage applied to the second sub-display area until the second brightness variance is less than the second brightness threshold, and the second chromaticity coordinate variance is less than the second chromaticity coordinate threshold.

It can be seen that the first comparator 301 and the second comparator 303 in the controller 300 may receive from the optical sensor 30 the acquired first brightness parameter and second brightness parameter, and the target brightness parameter may be stored within the controller 300. The results from the first comparator 301 and the second comparator 303 may be provided to the operator circuit 302 which may regulate the data voltage applied to the second sub-display area 20 based on the results from the first comparator 301 and the second comparator 303 until the brightness parameter of the second sub-display area 20 meets the specification.

As shown in FIG. 4, the system further comprises a memory 304 for storing the first data voltage suitable for the first sub-display area 10 and storing a regulated first data voltage as the second data voltage for the second sub-display area 20. Although in the example of FIG. 4, the memory is shown within the controller 300, the scope of the disclosure is not so limited. The memory 304 may be independent of the controller 300, which may be integrated into other controllers such as a timing controller, and may also exist independently as long as the source driver can acquire the data stored in the memory.

Some exemplary embodiments of the disclosure have been specifically described above. However, other variations to the disclosed embodiments can be understood and effected by those skilled in the art based on the study to the drawings, disclosures and claims when practicing the claimed subject matter. In the claims, the word "comprising" does not exclude the presence of other elements. Although some features are recited in different dependent claims, the present application is also intended to cover embodiments in which these features are combined.

The invention claimed is:

1. A gamma voltage correction method for a display module, wherein a display area of the display module comprises a first sub-display area that is adjacent to a second sub-display area, and wherein the first sub-display area and the second sub-display area are configured to be independently driven by a first source driver and a second source driver, respectively, the method comprising:

performing gamma curve adjustment to the first sub-display area according to a target gamma curve to obtain a first data voltage corresponding to a first grayscale;

driving the second sub-display area with the first data voltage so that the second sub-display area emits a second light;

regulating the first data voltage based on a difference between a first brightness of the first sub-display area and a second brightness of the second sub-display area when driven by the first data voltage respectively, to obtain a second data voltage for driving the second sub-display area to reduce the difference between the first brightness of the first sub-display area and the second brightness of the second sub-display area.

2. The method according to claim 1, wherein the method further comprises:

driving the first sub-display area with the first data voltage so that the first sub-display area emits a first light, while acquiring a first brightness parameter at a first position in the first sub-display area that is close to a boundary between the first sub-display area and the second sub-display area, wherein the first brightness parameter comprises a first brightness value and a first chromaticity coordinate corresponding to the first brightness value.

3. The method according to claim 2, wherein the method further comprises:

at a time of driving the second sub-display area with the first data voltage so that the second sub-display area emits the second light, acquiring a second brightness parameter at a second position in the second sub-display area close to the boundary, wherein the second brightness parameter comprises a second brightness value and a second chromaticity coordinate corresponding to the second brightness value.

4. The method according to claim 3, wherein first pixels at the first position in the first sub-display area and second pixels at the second position in the second sub-display area are connected to a same gate line.

5. The method according to claim 3, wherein the first grayscale comprises a maximum grayscale of an image displayed by the display module.

6. The method according to claim 4, wherein the method further comprises:

comparing the second brightness parameter with a target brightness parameter that comprises a target brightness value and a third chromaticity coordinate corresponding to the target brightness value, to obtain a first brightness variance between the second brightness value and the target brightness value and a first chromaticity coordinate variance between the second chromaticity coordinate and the third chromaticity coordinate.

7. The method according to claim 6, wherein the method further comprises:

when the first brightness variance exceeds a first brightness threshold, or the first chromaticity coordinate variance exceeds a first chromaticity coordinate threshold, changing a value of the first data voltage applied to the second sub-display area until the first brightness variance is less than the first brightness threshold and the first chromaticity coordinate variance is less than the first chromaticity coordinate threshold.

8. The method according to claim 7, wherein the method further comprises:

when the first brightness variance is less than the first brightness threshold, and the first chromaticity coordinate variance is less than the first chromaticity coordinate threshold, comparing the first brightness parameter with the second brightness parameter to obtain a second brightness variance between the first brightness value and the second brightness value and a second chromaticity coordinate variance between the first chromaticity coordinate and the second chromaticity coordinate.

9. The method according to claim 8, wherein the method further comprises:

when the second brightness variance exceeds a second brightness threshold, or when the second chromaticity coordinate variance exceeds a second chromaticity coordinate threshold, changing the first data voltage applied to the second sub-display area until the second brightness variance is less than the second brightness threshold and the second chromaticity coordinate variance is less than the second chromaticity coordinate threshold.

10. The method according to claim 9, wherein the method comprises:

when the second brightness variance is less than the second brightness threshold, and the second chromaticity coordinate variance is less than the second chromaticity coordinate threshold, storing a corresponding regulated first data voltage as the second data voltage.

11. The method according to claim 3, wherein the first sub-display area and the second sub-display area emit white light at the time of acquiring the first brightness parameter and the second brightness parameter.

12. A gamma voltage correction system for a display module, wherein a display area of the display module comprises a first sub-display area that is adjacent a second sub-display area, and wherein the first sub-display area and the second sub-display are configured to be independently driven by a first source driver and a second source driver, respectively, the gamma voltage correction system comprising:

an optical sensor configured to acquire a first brightness of the first sub-display area and a second brightness of the second sub-display area when driven by a first data voltage respectively, wherein the first data voltage is obtained by performing gamma curve adjustment to the first sub-display area according to a target gamma curve and corresponding to a first grayscale, and a controller configured to regulate the first data voltage based on a difference between a first brightness of the first sub-display area and a second brightness of the second sub-display area when driven by the first data voltage respectively, to obtain a second data voltage for driving the second sub-display area to reduce the difference between the first brightness of the first sub-display area and the second brightness of the second sub-display area.

13. The system according to claim 12, wherein the optical sensor is configured to acquire a first brightness parameter at a first position in the first sub-display area that is adjacent a boundary between the first sub-display area and the second sub-display area, and a second brightness parameter at a second position in the second sub-display area that is adjacent the boundary, wherein the first brightness parameter comprises a first brightness value and a first chromaticity coordinate corresponding to the first brightness value, and wherein the second brightness parameter comprises a second brightness value and a second chromaticity coordinate corresponding to the second brightness value.

14. The system according to claim 13, wherein first pixels at the first position in the first sub-display area and second pixels at the second position in the second sub-display area are connected to a same gate line.

15. The system according to claim 14, wherein the controller comprises a first comparator for comparing the second brightness parameter with a target brightness parameter that comprises a target brightness value and a third chromaticity coordinate corresponding to the target brightness value to obtain a first brightness variance between the second brightness value and the target brightness value, and a first chromaticity coordinate variance between the second chromaticity coordinate and the third chromaticity coordinate.

16. The system according to claim 15, wherein the controller comprises an operator circuit configured to, in response to the first brightness variance exceeding a first brightness threshold or the first chromaticity coordinate variance exceeding a first chromaticity coordinate threshold, change the first data voltage applied to the second sub-display area until the first brightness variance is less than the first brightness threshold and the first chromaticity coordinate variance is less than the first chromaticity coordinate threshold.

17. The system according to claim 16, wherein the controller comprises a second comparator configured to, in response to the first brightness variance being less than the first brightness threshold and the first chromaticity coordinate variance being less than the first chromaticity coordinate threshold, compare the first brightness parameter with the second brightness parameter to obtain a second brightness variance between the first brightness value and the second brightness value and a second chromaticity coordinate variance between the first chromaticity coordinate and the second chromaticity coordinate.

18. The system according to claim 17, wherein the operator circuit is configured to, in response to the second brightness variance exceeding a second brightness threshold or the second chromaticity coordinate variance exceeding a second chromaticity coordinate threshold, change the first data voltage applied to the second sub-display area until the second brightness variance is less than the second brightness threshold and the second chromaticity coordinate variance is less than the second chromaticity coordinate threshold.

19. The system according to claim 18, wherein the system further comprises a memory configured to store the first data voltage and configured to store a corresponding regulated first data voltage as the second data voltage.

20. The system according to claim 12, wherein the first grayscale comprises a maximum grayscale of an image displayed by the display module.

* * * * *